US005577661A

United States Patent [19]

Puett, Jr.

[11] Patent Number: 5,577,661

[45] Date of Patent: Nov. 26, 1996

[54] POOL WATER HEATING AND CIRCULATING SYSTEM

[75] Inventor: Edwin E. Puett, Jr., Stuart, Fla.

[73] Assignee: Anser, Inc., Stuart, Fla.

[21] Appl. No.: 517,340

[22] Filed: Aug. 21, 1995

[51] Int. Cl.[6] ..... F24D 3/02

[52] U.S. Cl. ..... 237/1 R; 122/20 B; 126/19.5; 237/63

[58] Field of Search ..... 237/1 R, 56, 57, 237/59, 63; 122/20 B; 126/19.5, 562, 609

[56] References Cited

U.S. PATENT DOCUMENTS

| | | | |
|---|---|---|---|
| 1,228,932 | 6/1917 | Laun . | |
| 1,231,208 | 6/1917 | Semmler . | |
| 1,489,501 | 4/1924 | Miner, Jr. . | |
| 3,223,150 | 12/1965 | Tramontini | 165/34 |
| 3,785,359 | 1/1974 | Whittaker | 126/19.5 |
| 4,027,631 | 6/1977 | Lavery | 122/26 |
| 4,274,390 | 6/1981 | Azuma | 126/19.5 |
| 4,489,708 | 12/1984 | Yamamoto et al. | 126/19.5 X |
| 5,039,007 | 8/1991 | Wolfer | 126/19.5 X |
| 5,190,025 | 3/1993 | Chen | 126/19.5 |
| 5,435,485 | 7/1995 | Atterbury | 237/2 B |

*Primary Examiner*—William E. Tapolcai
*Attorney, Agent, or Firm*—Everett G. Diederiks, Jr.

[57] ABSTRACT

A pool heating and circulating system incorporates an internal combustion engine that drives a pump for developing a flow of water. The internal combustion engine has associated therewith an exhaust pipe which is connected to a heat exchanger. An outlet of the pump is also connected to the heat exchanger such that the water extracts the heat generated by operation of the internal combustion engine. The water flowing out of the heat exchanger is then delivered to a filter and a return line. A heat insulating shield is provided about the exhaust pipe to shield the exhaust pipe from excess exposure to cool air. A bypass line can be provided between the outlet of the pump and the heat exchanger so that water can bypass the heat exchanger and flow directly to the return line and filter when it is determined that the pool water temperature is at a desirable temperature. A valve is actually positioned in the bypass line to vary the flow through the heat exchanger.

20 Claims, 3 Drawing Sheets

POOL WATER HEATING AND CIRCULATING SYSTEM

BACKGROUND OF THE INVENTION

1. Field of the Invention

The present invention pertains to the art of pools and, more particularly, to heating and circulating systems for pools.

2. Discussion of the Prior Art

Community and backyard swimming pools have become a common part of recreation and exercise activities. In order to expand the usable season for swimming pools, it has become somewhat commonplace to utilize auxiliary heaters in combination with conventional circulation systems.

In FIG. 1 a typical, known pool heating and circulating system is generally illustrated at 2. In such an arrangement, an electric motor 5 that receives power through an electrical line 7 is used to drive a pump 10 through a transmission member 12. Pump 10 is connected to a suction line 15 that stems, at least in part, from a skimmer 17 in order to draw water from a swimming cavity 18. Water flowing from pump 10 is delivered through an output line 20 to a filter 23 where the water is purified such as through sand filtration or the like. From the filter 23, the water passes to a return line 27 and is delivered back to the swimming cavity 18 through a plurality of nozzle outlets 30–33.

If it is desired to also heat the water, an electric heater 35 is generally placed in series with and downstream of the filter 23. The heater 35 would be periodically activated to maintain the water in swimming cavity 18 at a desired temperature based on the sensed temperature of the water. A typical electric heater 35 is generally illustrated in FIG. 2. As its main components, heater 35 includes a condenser 39, an evaporator 41, an expansion valve 43 and a compressor 46 arranged in series, as well as a fan unit 49. In general, such a heater 35 functions to transfer heat from the air surrounding the unit to the water. This is performed by transforming a liquid refrigerant placed in the evaporator 41 into a gas by drawing in warm air by means of fan unit 49. The gas flows through the compressor 46 wherein the gas is compressed to a much higher temperature. This heated gas then enters the condenser 39 wherein it is placed in heat exchange relationship with the pool water which causes the water to be heated and the gas to be condensed to a liquid. This process continues as long as heater 35 remains on.

There are various drawbacks associated with such known pool heating and circulating systems. First of all, the electric motor 5 and the heater 35 are essentially two independent components, even though they can work in unison, and require separate power lines. Even though each of these units may be considered rather energy efficient, together they can be quite costly to operate. In addition, this type of heater 35 can really only function with moderate ambient temperature changes since it relies on the heat available in the air to heat the water.

There are also other types of heating systems that are available including, for example, passive heating systems, electrical resistance heating units and propane heating arrangements. All of these additional heating arrangements also suffer from various drawbacks. For instance, the passive heating systems are completely dependent upon the sun and are greatly affected by numerous variables including cloud coverage; electrical resistance heating units can boost the temperature of the pool water rather quickly but are rather costly to operate; and propane heating arrangements are simple not widespread due to the need to have a separate source of propane fuel and since they are only slightly more efficient than electrical resistance heating units.

Therefore, there exists a need in this art for a more efficient heating and circulating system that can be used in a wide range of climates and, in addition, a pool heating and circulating system that is compact so that it occupies a minimal of space.

SUMMARY OF THE INVENTION

The present invention pertains to a pool heating and circulating system that incorporates an internal combustion engine. The internal combustion engine drives a pump for developing a flow of water. The internal combustion engine has associated therewith an exhaust pipe which is connected to a heat exchanger. An outlet of the pump is also connected to the heat exchanger such that the water extracts the heat generated by operation of the internal combustion engine. The water flowing out of the heat exchanger is then delivered to a filter and a return line.

The heat exchanger is actually divided into first and second chambers that are in heat exchange relationship with respect to each other. At an outlet of the first chamber into which the exhaust from the internal combustion engine flows is a terminal exhaust pipe portion which is open to the ambient. In the preferred embodiment, this terminal portion is angled to direct the exhaust flow away from the internal combustion engine and the exhaust pipe to prevent convection cooling thereof. Actually, the flow coming out of this terminal portion has been found to be quite cool and therefore this terminal portion is preferable directed at the pump to provide some cooling thereof. In addition, a heat insulating shield is provided about the exhaust pipe and at least between the exhaust pipe and the terminal exhaust outlet portion to shield the exhaust pipe from excess exposure to cool air.

In a preferred embodiment, a bypass line is provided between the outlet of the pump and the heat exchanger so that water can bypass the heat exchanger and flow directly to the return line and filter when it is determined that the pool water temperature is at a desirable temperature. A valve is actually positioned in the bypass line to vary the flow through the heat exchanger. This valve can be controlled automatically based on sensed pool water temperature or manually. A one-way check valve is positioned between the interconnection of the bypass line with the return line and the heat exchanger to prevent any backflow towards the heat exchanger. In addition, a pressure relief valve and a overall system flow control valve can be arranged in the return line.

In another embodiment of the invention, a water cooled internal combustion engine is utilized. In this embodiment, an engine cooling water inlet line stems from the return line to a cooling jacket associated with the engine. A thermostatic valve is positioned in this line to control the flow of cooling water to the engine based on sensed engine operating temperature. Water flowing through the jacket is delivered back to the return line through a cooling water outlet line.

With this arrangement, only a single unit, i.e. the internal combustion engine, needs to be provided to perform both the functions of driving the pump and providing the energy needed to heat the water. Since the engine performs both of these functions and is closely positioned to the heat exchanger, a very compact heating and circulating system is provided. In addition, since the heat energy developed and lost in driving the pumps in prior art arrangements is avoided, the present system is very energy efficient comparatively. Furthermore, since the internal combustion engine develops a flow of exhaust at an elevated temperature regardless of the ambient temperature, the heating and circulating system of the invention can be used in a wide range of climates.

Other features and advantages of the pool heating and circulation system of the invention will become more readily apparent from the following detailed description of preferred embodiments thereof when taken in conjunction with the following drawings wherein like reference numerals refer to corresponding parts in the several figures.

DETAILED DESCRIPTION OF THE PREFERRED EMBODIMENTS

Figure 1:
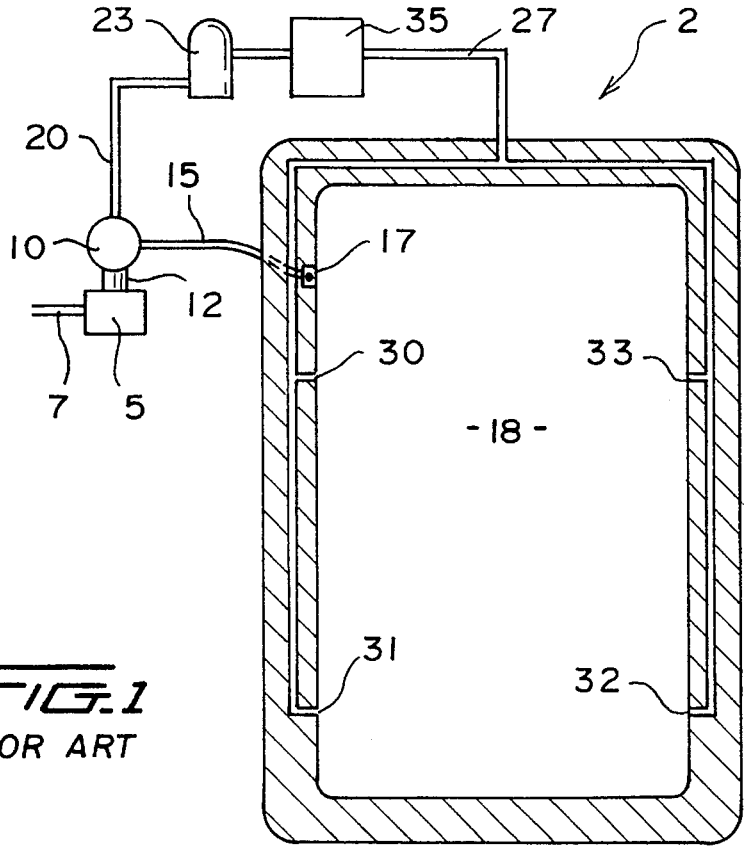
FIG. 1 PRIOR ART
FIG. 1 is a schematic view of a typical pool heating and circulating system according to the prior art.
Figure 2:
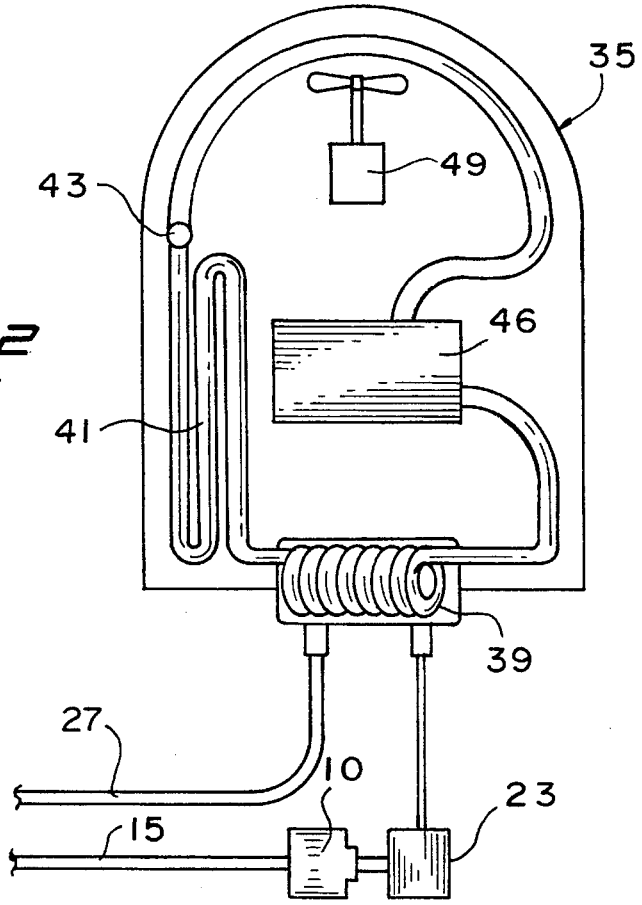
FIG. 2 PRIOR ART
FIG. 2 is a schematic view of a heating unit incorporated in the prior art system of FIG. 1.
Figure 3:
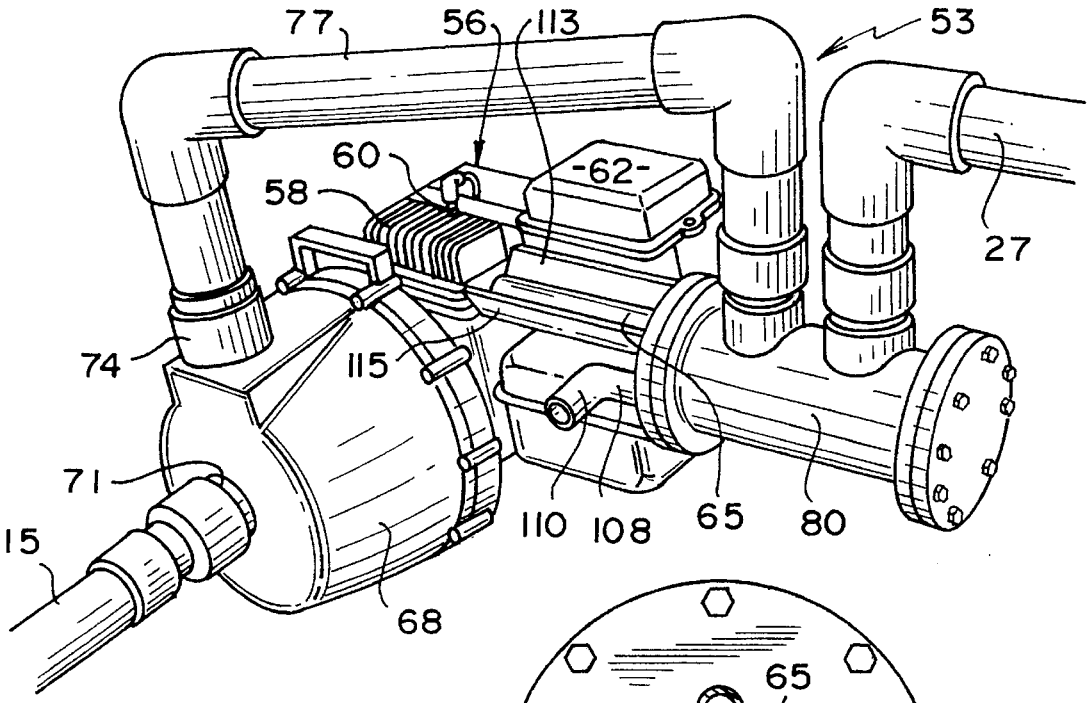
FIG. 3 is a perspective view of a first preferred embodiment of the pool heating and circulating system of the invention.
Figure 4:
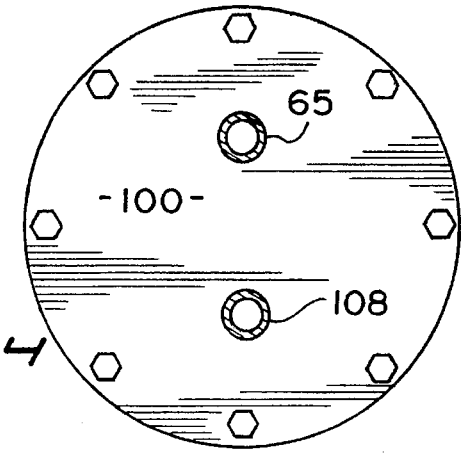
FIG. 4 is an end view of a heat exchanger incorporated in the pool heating and circulating system of FIG. 3.
Figure 5:
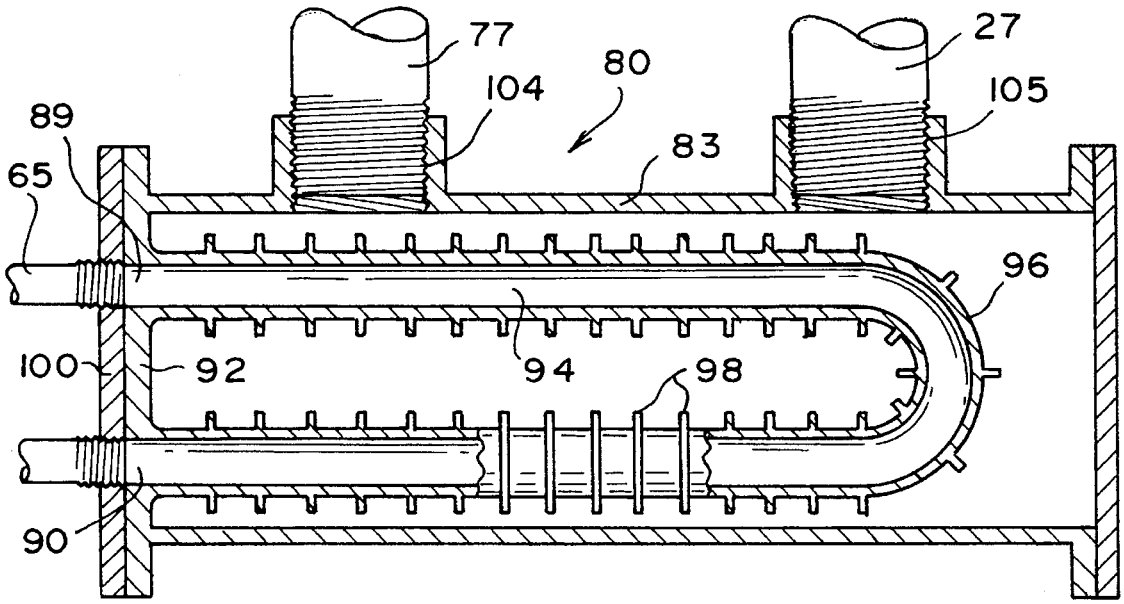
FIG. 5 is a cross-section view of the heat exchanger incorporated in the pool heating and circulating system of FIG. 3.

With initial reference to FIGS. 3–5, a first preferred embodiment of the pool heating and circulating system of the invention is generally indicated at 53 and will now be described. Pool heating and circulating system 53 includes an internal combustion engine 56. In the embodiment depicted, internal combustion engine 56 constitutes a gas driven engine which is provided with a plurality of fins 58 for air cooling purposes. Internal combustion engine 56, as depicted, includes a single spark plug 60, an air filter assembly 62 and an exhaust pipe 65. In general, internal combustion engine 56 is readily available in the marketplace (such as those sold by BRIGGS AND STRATTON) and can range in horsepower rating from as low as 3.5 hp for a moderate-size pool. In the preferred embodiment, engine 56 is either in an off state or run at an optimal fuel efficiency speed. Since the actual construction and operation of internal combustion engine 56 is not considered part of the present invention, it will not be further discussed herein in detail.

Internal combustion engine 56 includes an output driveshaft (not shown) which drives a water pump 68. Again, since water pump 68 is readily available in the marketplace and the structure thereof is not considered part of the invention, the internal components of pump 68 will not be described herein. Pump 68 has associated therewith an input port 71 that is attached to suction line 15 and an output port 74. Attached to output port 74 is a transfer conduit 77 that leads to a heat exchanger 80.

Heat exchanger 80 includes a housing 83 that is provided with first and second ports 89 and 90 in a first end wall 92 thereof. First and second ports 89 and 90 open into a first chamber 94 of heat exchanger 80. In the preferred embodiment shown, first chamber 94 is defined by a generally U-shaped tube 96 that is provided with a plurality of external, radially extending fins 98. U-shaped tube 96 opens outside of heat exchanger 80 through an end plate 100. Heat exchanger 80 also defines a second chamber 102 within housing 83. Actually, first chamber 94 extends within second chamber 102 such that first and second chambers 94 and 102 are in heat exchange relationship within housing 83. Opening into second chamber 102 are third and fourth ports 104 and 105. Attached to third port 104 is transfer conduit 77 by any means known in the art such as a threaded connection. Return line 27 is connected to fourth port 105.

Exhaust pipe 65 leads from internal combustion engine 56 and is secured to end plate 100 at first port 89. This connection can take various forms including a threaded connection as illustrated in FIG. 5. With this arrangement, exhaust pipe 65 opens directly into first chamber 94 defined by U-shaped tube 96. At second port 90, end plate 100 has secured thereto a terminal extension portion 108 for the exhaust of the internal combustion engine 86. Terminal portion 108 is open to atmosphere and preferably includes an end 110 that is angled away from exhaust pipe 65.

With this arrangement, the heat generated during operation of internal combustion engine 56 and exhausted through exhaust pipe 65 is forced to flow through first chamber 94 of heat exchanger 80. At the same time, pump 68 delivers a flow of water through transfer conduit 77 into second chamber 102 of heat exchanger 80. The water flowing into second chamber 102 will be heated by direct contact with U-shaped tube 96 and will then pass out of heat exchanger 80 through fourth port 105 and return line 27. Of course, the exhaust flowing through exhaust pipe 65 will continuously flow through U-shaped tube 96 and out terminal portion 108 during operation of internal combustion engine 56. In use, it has been found that the temperature of the exhaust exiting terminal portion 108 has been quite cool and, for this purpose, terminal portion 108 includes the angled end 110 to assure that exhaust pipe 65 is not cooled by this flow of exhaust. In fact, it is preferable to have angled end 110 slightly directed towards pump 68 to provide convection cooling thereof. In addition, a heat insulating shield 113 is preferably provided around a majority of the outer peripheral surface of exhaust pipe 65. Heat insulating shield 113 particularly includes a substantially upstanding portion 115 extending between exhaust pipe 65 and terminal portion 108. Although not shown, it is contemplated to locate engine 56, pump 68 and heat exchanger 80 in a sound insulating enclosure to minimize the perceivable amount of noise generated during operation of the system.

Figure 6:
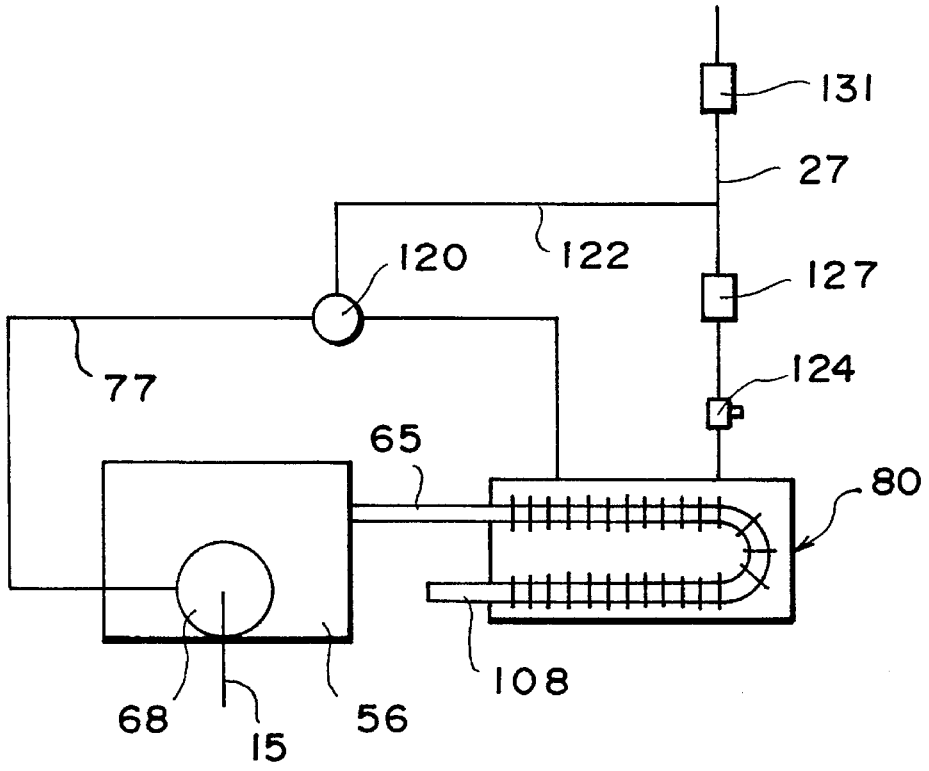
FIG. 6 is a schematic view of a second preferred embodiment of the invention.

The embodiment illustrated in FIG. 6 is substantially identical to the embodiment described above with respect to FIGS. 3–5 except that transfer conduit 77 has position therein a flow directing valve 120 that leads to a bypass line 122. With this arrangement, the percentage of the water flow from pump 68 to heat exchanger 80 can be controlled simply by repositioning flow directing valve 120. Of course, this percentage of flow will affect the rate at which the water is heated. In the simplest form of this embodiment, flow directing valve 120 is manually adjusted to set the desired bypass flow of water through bypass line 122, however, flow directing valve 120 could be automatically controlled based on sensed pool temperature in a manner that would be readily apparent to one of ordinary skill in the art given this description.

As also illustrated in FIG. 6, interposed between the connection junction (not labeled) of bypass line 122 and return line 27 and fourth port 105 of heat exchanger 80 is a pressure relief valve 124 and a one-way check valve 27. Pressure relief valve 124 simply functions to reduce any extreme water pressure encountered upon heating of the water as it flows through heat exchanger 80 and one-way check valve 127 prevents any backflow of water from bypass line 122 toward heat exchanger 80. Finally, located downstream of one-way check valve 127 and bypass line 122 in return line 27 is a flow control valve 131. Flow control valve 131 is utilized to control, in conjunction with the rate at which pump 68 is driven by internal combustion engine 56, the overall rate of flow of water circulated through the system. Again, flow control valve 131 is preferably manually controlled but could also be automatically controlled such as through the use of a timer which could also be used to control the operating times for internal combustion engine 56.

Figure 7:
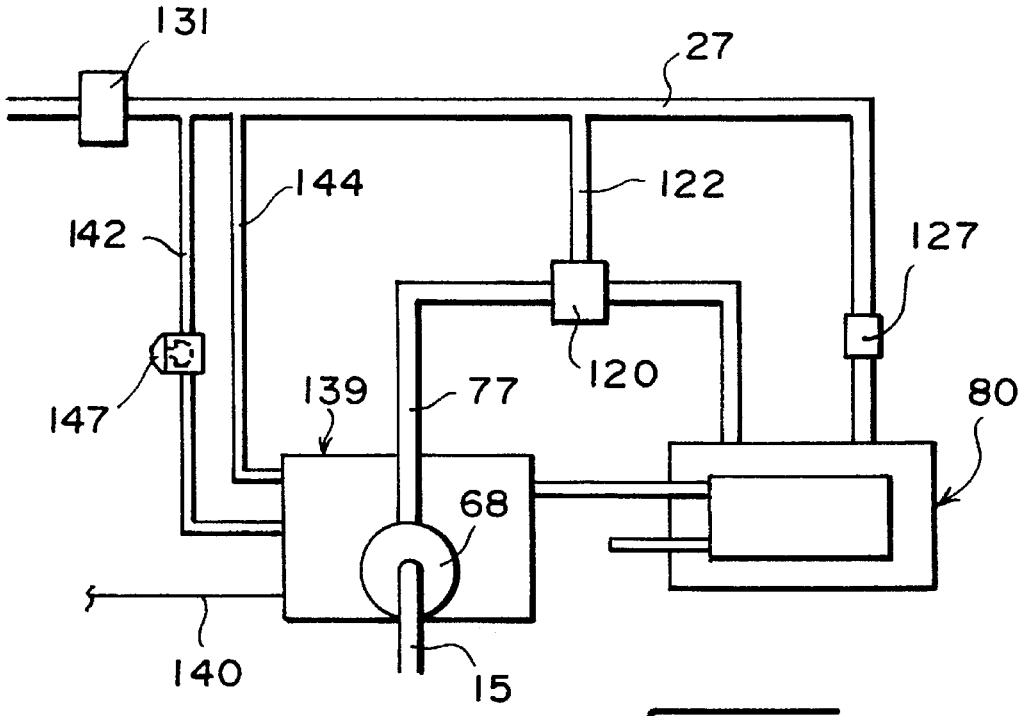
FIG. 7 is a schematic view of a third preferred embodiment of the invention.

FIG. 7 illustrates a third embodiment of the invention which is substantially identical to the embodiments described above except that a water cooled internal combustion engine 139 is utilized. Engine 139 receives fuel from a fuel line 140 and at least a portion thereof is surrounded by a jacket (not labeled) through which cooling water can flow. Again, the particulars of engine 139 are not depicted since such engines are available in the marketplace and are sold by various manufacturers, including BRIGGS AND STRATTON. For this embodiment, a cooling water inlet line 142 is interconnected between return line 27 and the jacket of engine 139 to provide a flow of cooling water to engine 139. A cooling water outlet line 144 functions to redeliver this flow of water to return line 27. Preferably, a thermostat valve 149 is provided in cooling water inlet line 142 to control the amount of flow through line 142 based on sense engine operating temperature.

Based on the above, it should be readily apparent that the pool heating and circulating system 53 of the present invention is compact in nature and is efficient to operate, especially since the heat generated during operation of the internal combustion engine 56, 139 in order to drive pump 68 is not wasted but is rather used as the source of heat for the water. The particular heat exchanger 80 preferably utilized is of the type commonly marketed as heat exchangers for hydraulic systems, although other known types of heat exchangers could be utilized. It should be noted that, although internal combustion engine 56,139 are preferably gas driven, they could also utilize diesel fuel, natural gas or the like. All of the conduits and lines described above are preferably formed of PVC. By way of example, with these lines and conduits having approximately 1.5" diameters, suction line 27 which would have a 2"diameter and cooling water inlet and outlet lines 142 and 144 would have associated diameters of 0.5". Based on experimental tests, it has been found that the pool heating and circulating system 53 of the present invention can be operated to circulate pool water at a rate approximately two times that of a conventional system while also increasing the rate at which the water is heated and while still being more cost efficient. In fact, it has been found that the pool heating and circulating system 53 of this invention can both heat and circulate pool water at approximately the same cost associated solely with electric-based circulating systems known in the art.

Although described with respect to preferred embodiments of the invention, it should be readily understood that various changes and/or modifications can be made without departing from the spirit of the invention. In general, the invention is only intended to be limited by the scope of the following claims.

I claim:

1. A pool water heating and circulating system comprising:

an internal combustion engine having an output driveshaft and an exhaust pipe;

a pump drivingly connected to the output driveshaft of said internal combustion engine, said pump including an input port adapted to be connected to a suction conduit for drawing water from a pool and an output port;

a heat exchanger including a housing divided into first and second internal chambers in intimate contact with each other, said housing being provided with first, second, third and fourth ports with said first and second ports opening into said first chamber and said third and fourth ports opening into said second chamber, said first port being connected to said exhaust pipe and said second port being open to atmosphere such that exhaust developed during operation of said internal combustion engine is directed into said first chamber through said exhaust pipe and said first port, flows through said first chamber and exits said first chamber through said second port, said fourth port being adapted to be attached to a return conduit for delivering water to a pool; and transfer conduit means fluidly interconnecting the output port of said pump and the third port of said heat exchanger such that water drawn into said pump from a pool through said inlet port can be delivered to the third port of said heat exchanger through said transfer conduit means heated by direct contact with said first chamber as the water flows through said second chamber and then can exit the housing of said heat exchanger through said fourth port to be delivered back to the pool.

2. The pool water heating and circulating system according to claim 1, wherein the first chamber of said heat exchanger comprises a tube extending within the second chamber.

3. The pool water heating and circulating system of claim 2, wherein said tube is provided with a plurality of longitudinally spaced and radially outwardly extending fins.

4. The pool water heating and circulating system of claim 1, wherein said exhaust pipe is threadably attached to the first port of said heat exchanger.

5. The pool water heating and circulating system of claim 1, further comprising a heat insulating shield extending about at least a portion of said exhaust pipe.

6. The pool water heating and circulating system of claim 5, further comprising a terminal exhaust extension tube attached to the second port of said heat exchanger, said terminal exhaust extension tube opening to atmosphere away from said internal combustion engine.

7. The pool water heating and circulating system of claim 6, wherein said heat insulating shield is positioned between said exhaust pipe and said terminal exhaust extension tube.

8. The pool water heating and circulating system of claim 1, wherein said transfer conduit means includes a bypass line for directing a flow from the output port of said pump away from said heat exchanger.

9. The pool water heating and circulating system of claim 8, further comprising a valve for controlling the flow through said bypass line.

10. The pool water heating and circulating system of claim 9, further comprising means for automatically positioning said valve based on a sensed water temperature downstream of said heat exchanger.

11. The pool water heating and circulating system of claim 8, further comprising a flow control valve located downstream of said transfer conduit means and said heat exchanger.

12. The pool water heating and circulating system of claim 8, further comprising a one-way check valve positioned between said bypass line and the fourth port of said heat exchanger.

13. The pool water heating and circulating system of claim 1, further comprising a pressure relief valve located downstream of said heat exchanger.

14. The pool water heating and circulating system of claim 1, wherein said internal combustion engine is encased in a water jacket having associated therewith a cooling water flow inlet line and a cooling water flow outlet line each of which are connected to a return line, attached to the fourth port of said heat exchanger, downstream of said heat exchanger.

15. The pool water heating and circulating system of claim 14, further comprising a thermostatic valve located in one of said cooling water flow inlet and outlet lines for controlling a flow through said water jacket.

16. A pool water heating and circulating system comprising:

a heat exchanger including a housing divided into first and second chambers, said housing being provided with first, second, third and fourth ports with said first and second ports opening into said first chamber and said third and fourth ports opening into said second chamber, said second port being open to atmosphere and said fourth port being adapted to be attached to a return conduit for delivering water to a pool;

an internal combustion engine having an output driveshaft and an exhaust pipe, said exhaust pipe being connected to the first port of said heat exchanger;

a pump drivingly connected to the output driveshaft of said internal combustion engine, said pump including an input port adapted to be connected to a suction conduit for drawing water from a pool and an output port; and transfer conduit means fluidly interconnecting the output port of said pump and the third port of said heat exchanger.

17. The pool water heating and circulating system of claim 16, further comprising a heat insulating shield extending about at least a portion of said exhaust pipe.

18. The pool water heating and circulating system of claim 16, wherein said transfer conduit means includes a bypass line for directing a flow from the output port of said pump away from said heat exchanger.

19. The pool water heating and circulating system of claim 18, further comprising a one-way check valve positioned between said bypass line and the fourth port of said heat exchanger.

20. The pool water heating and circulating system of claim 16, wherein said internal combustion engine is encased in a water jacket having associated therewith a cooling water flow inlet line and a cooling water flow outlet line each of which are connected to a return line, attached to the fourth port of said heat exchanger, downstream of said heat exchanger.

* * * * *